US005321594A

United States Patent [19]

Hegemann et al.

[11] Patent Number: 5,321,594

[45] Date of Patent: Jun. 14, 1994

[54] HEADLIGHT FOR VEHICLES

[75] Inventors: Klaus Hegemann; Josef Bals, both of Lippstadt, Fed. Rep. of Germany

[73] Assignee: Hella KG Hueck & Co., Lippstadt, Fed. Rep. of Germany

[21] Appl. No.: 106,606

[22] Filed: Aug. 16, 1993

[30] Foreign Application Priority Data

Aug. 22, 1992 [DE] Fed. Rep. of Germany ..... 4227888

[51] Int. Cl.[5] ..... F21V 31/00

[52] U.S. Cl. ..... 362/267; 362/61; 362/310

[58] Field of Search ..... 362/61, 80, 267, 310, 362/306, 307, 343

[56] References Cited

U.S. PATENT DOCUMENTS

| | | | |
|---|---|---|---|
| 4,563,730 | 1/1986 | Saito | 362/310 X |
| 4,604,679 | 8/1986 | Rolando et al. | 362/267 X |
| 5,113,331 | 5/1992 | Nagengast | 362/267 |

FOREIGN PATENT DOCUMENTS

| | | |
|---|---|---|
| 7626943 | 2/1978 | Fed. Rep. of Germany . |
| 2846990A1 | 5/1980 | Fed. Rep. of Germany . |
| 3540130C1 | 4/1987 | Fed. Rep. of Germany . |

*Primary Examiner*—Stephen F. Husar

*Attorney, Agent, or Firm*—Griffin Butler Whisenhunt & Kurtossy

[57] ABSTRACT

A headlight for a vehicle has a bowl shaped light-transmissive shield and a housing of resinous plastic. The housing has at its outer peripheral edge a receiving surface for receiving a foot of the light-transmissive shield. Protrusions on the receiving surface serve as a seating for the light-transmissive shield and, upon mounting the light-transmissive shield on the housing, these protrusions are deformed by pressure of the foot of the light-transmissive shield against them so that they form a narrow, surrounding, bed on at least one side of the foot of the light-transmissive shield. The foot of the light-transmissive shield is held in this bed by a mechanical device which extends between the light-transmissive shield and the housing.

24 Claims, 2 Drawing Sheets

HEADLIGHT FOR VEHICLES

BACKGROUND OF THE INVENTION

This invention concerns a headlight for vehicles of a type having a bowl-shaped light-transmissive shield and a housing of resinous plastic which is closed by the light-transmissive shield, with the housing having a receiving surface extending about a free peripheral edge thereof, which is arranged perpendicular to a mounting direction of the light-transmissive shield on the housing, on which a foot of the light-transmissive shield is mounted so as to have a large side clearance, perpendicular to the mounting direction, and with an attachment of the light-transmissive shield to the housing resulting from a pressure-applying, mechanical, device acting on the foot of the light-transmissive shield in the direction of the receiving surface.

Headlights are known from German Patent No. DE 35 40 130 Cl (commonly owned with the instant application) in which a foot of a bowl-shaped light-transmissive shield is placed in a U-shaped (in cross section) receiving channel of a housing. An adhesive is placed in the receiving channel before the light-transmissive shield is mounted therein which encloses the foot of the light-transmissive shield after the light-transmissive shield has been placed therein. After the adhesive has hardened, it provides a very strong coupling of the housing and the light-transmissive shield without additional mechanical elements and, further, the adhesive serves as a good sealing medium. However, it is disadvantageous that with a housing manufactured of resinous plastic the choice of the plastics is quite limited because not all resinous plastics, for example the thermoplastic polypropylene, can be adhered with an inexpensive adhesives. This disadvantage can be overcome with a mounting technology employed for a known headlight of German Patent DE 28 46 990 Al which is generally of a type as that of this application. A binding, or coupling, mass placed between a light-transmissive shield and a housing edge in the headlight of German Patent DE 28 46 990 Al is semi-fluid, or viscous, so that the adhering effect of this binding mass is quite small and the coupling mass serves mainly as a sealing medium. With this coupling technique it has been found that the light-transmissive shield, in its mount on the headlight, because of the fluidity of the sealing medium, wanders in the direction of a force applied thereto by gravity until an upper side of its foot contacts an inner leg, and/or a lower side contacts an outer leg, of a receiving channel. The danger of such a "wandering" of the light-transmissive shield is particularly great at high temperatures because the degree of firmness of the binding mass is than reduced. Also, a mechanical device formed by a locking nose on an outer leg of the receiving channel, which engages a step or shoulder in the light-transmissive shield and which locks the light-transmissive shield against movement in the mounting direction, does not prevent the light-transmissive shield from wandering downwardly.

A clearance between two legs of a U-shaped receiving channel is larger than a thickness of a foot of a light-transmissive shield and this increases with the size of a resinous plastic housing, and the clearance is particularly large if a particularly inexpensive plastic is used in the manufacture of the housing, where large tolerances arise for the housing. The large manufacturing tolerances of light-transmissive shields of pressed or molded glass also contribute to enlarging the receiver channel. In the known headlights of German Patent DE 28 46 990 Al the mechanical devices which lock the light-transmissive shield to the housing are spring loaded noses which are formed on the outer leg of the receiver channel and which engage in a step in the outer surface of the light-transmissive shield. In this manner the light-transmissive shield is only held to the housing against movement in a mounting direction.

German Gebrauchsmuster DE GM 76 26 043 discloses a headlight in which a rubber-like seal is placed in a U-shaped (in cross section) receiver channel. A foot of a light-transmissive channel is pressed on the rubber seal by a mechanical device. It is disadvantageous in this arrangement that the seal of rubber is a separate part, thereby cost intensifying the manufacturing thereof because it is either a molded seal or a extruded seal. Such on extruded seal must be cut to exactly correct lengths so that no unsealed portions are created along contact points. Additionally, the position of a light-transmissive shield must be accurately maintained thereon by a manufacturing apparatus until the mechanical device is mounted. The mechanical device is of a spring-steel manufactured, C-shaped, holding spring, one leg of which engages a step on the light-transmissive shield and the other leg of which engages a step on the housing. Further, this clamp must be constructed to be quite stable so that a pressure applied by the light-transmissive shield to the rubber seal is sufficiently high that the bulky seal is deformed by the foot of the light-transmissive shield to prevent the foot of the light-transmissive shield from wandering downwardly.

It is an object of this invention to provide a headlight of the general type set forth above to have a foot of a light-transmissive shield centered on a larger receiving surface, which is especially wider than is necessary for the thickness of the light-transmissive shield because of manufacturing tolerances, without the need of additional manufacturing parts or work operations, but yet the light-transmissive shield is maintained centered, or positioned, on the housing in a direction perpendicular to a mounting direction.

SUMMARY

This object of this invention is solved by forming a seating for a foot of a light-transmissive shield of protrusions projecting out of a receiving surface which, upon mounting the light-transmissive shield on the housing, are deformed by pressure of the foot of the light-transmissive shield against the protrusions so that they define a narrow surrounding bed extending at least on one side of the light-transmissive shield.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
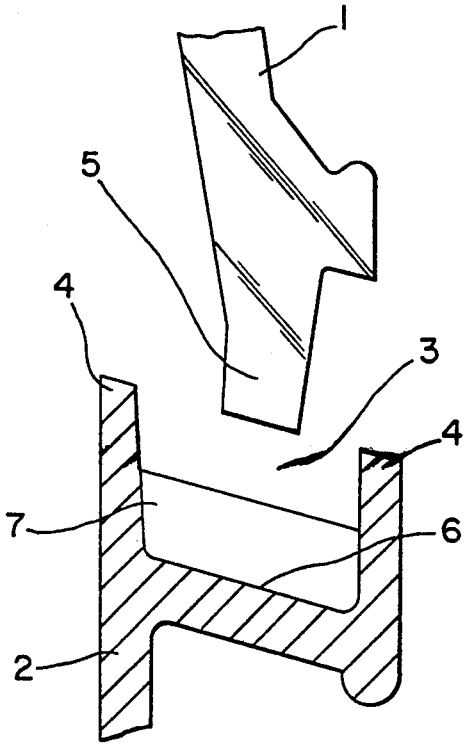
FIG. 1 is a segmented, exploded, cross-sectional view of a headlight of this invention showing a light-transmissive shield before it is mounted in a receiving channel of a housing in which a protrusion is a cross web.
Figure 2:
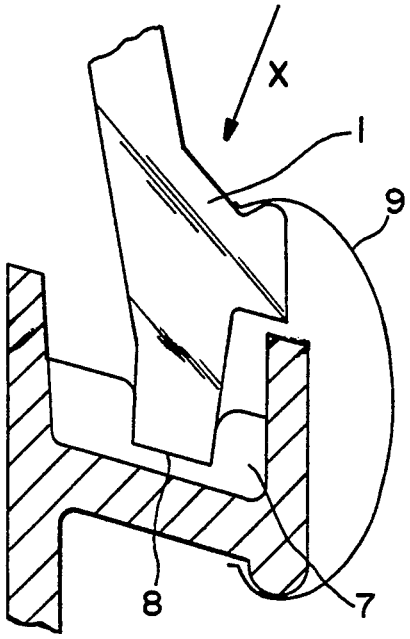
FIG. 2 is a view similar to FIG. 1 of the FIG. 1 embodiment after the foot of the light-transmissive shield has been mounted in the receiving channel with the foot of the light-transmissive shield having pressed itself a receiving bed by deformation.

Looking now at the drawings, an outer edge portion of a bowl-shaped light-transmissive shield 1 and an outer edge portion of a pot-shaped housing 2, which can also be a reflector, are shown. The housing 2 is constructed of a thermoplastic resinous plastic, such as polypropylene, and the light-transmissive shield 1 is manufactured of a glass. A clearance between legs 4 of a U-shaped (in cross section) receiver channel 3 is substantially greater than, a thickness of a foot 5 of the light-transmissive shield. Protrusions, or raised areas, which are distributed over the entire length of the receiver channel 3, extend outwardly from a receiver surface 6 of the receiving channel 3, which protrusions serve as support surfaces for the foot 5 of the light-transmissive shield 1. In FIGS. 1, 2, 6, 7, 8, 9 and 11 the protrusions 7 are cross webs which extend perpendicular to the receiver channel to hold the legs 4 of the receiver channel together.

With an automated mounting, the light-transmissive shield 1 is exactly oriented and mounted on the housing 2 by an apparatus. When the light-transmissive shield 1 is placed on the housing 2, the foot 5 of the light-transmissive shield first extends between the legs 4 of the U-shaped receiver channel 3 and after contact of its foot surface 10 on the protrusions 7 it is pressed with such force against this seat that the protrusions 7 are deformed to form a narrow bed 8 contacting the foot 5 of the light-transmissive shield. This bed 8 affixes the light-transmissive shield 1 laterally or radially, to its mounting direction X relative to the housing 2. The locking of the light-transmissive shield 1 to the housing 2 in the mounting direction X results from a mechanical device 9 which is formed of a spring-steel, C-shaped, bowed clamp. The clamp 9 grips, at respective opposite free ends thereof, into steps of the light-transmissive shield 1 and the housing 2 and presses the light-transmissive shield 1 in the mounting direction of the housing 2.

Figure 7:
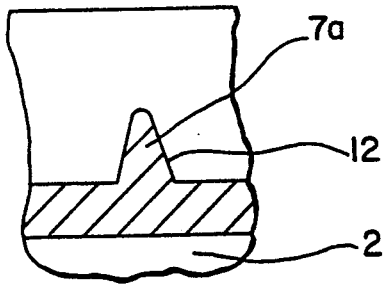
FIGS. 7 through 11 are each a cross-sectional view of a different embodiment of protrusions from a base surface of a receiver channel.
Figure 8:
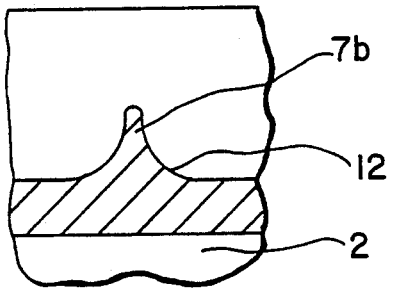
Figure 11:
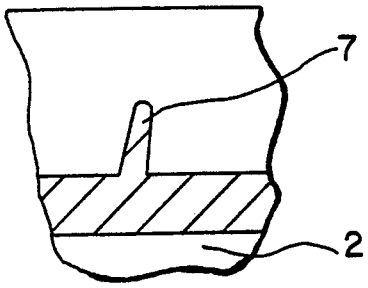
Figure 9:
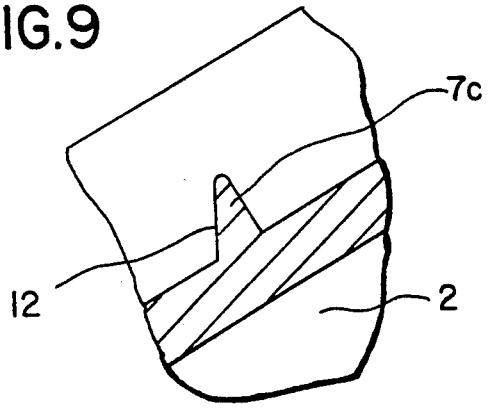
Figure 6:
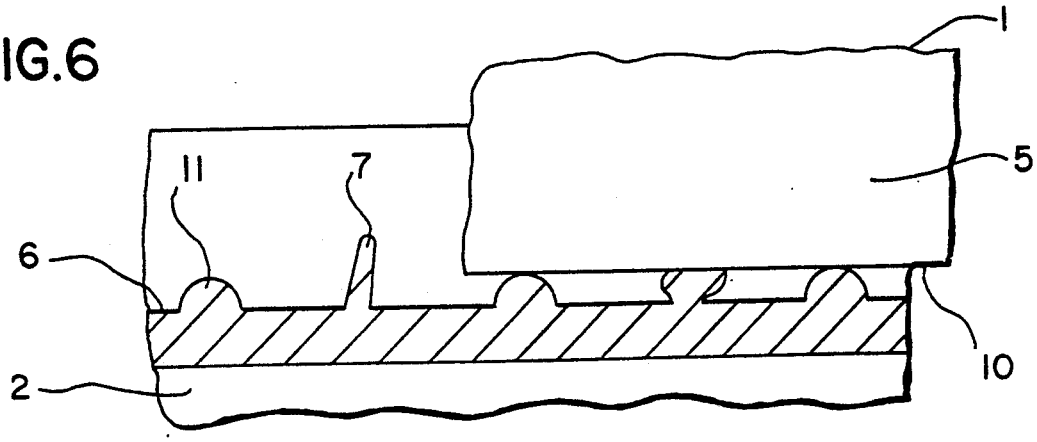
FIG. 6 is a segmented, center-axial cross-sectional view of a receiver channel of a housing with a cross web, both before and after its deformation, and projections which form stops for a light-transmissive shield.

In FIGS. 6 and 11 the protrusions 7 are shown as a thin-wall webs which extend at acute angles from the base surface 6 of the receiver channel 3. After deformation of the thin-wall web 7 by the foot 5 of the light-transmissive shield, the foot 5 of the light-transmissive shield lies on stops 11 which are projections formed on the base surface 6 of the receiver channel 3 between the protrusions 7. In FIGS. 7, 8 and 9, the cross webs taper inwardly to a point toward their outer free ends. In FIGS. 7 and 9, side surfaces 12 of the cross webs 7*a* and 7*c* extend away from the base surface 6 to form acute-angles with one another while in FIG. 9 one of the side surfaces extends in the mounting direction X of the light-transmissive shield. In FIG. 8, the side surfaces 12 extend, in cross section to a cross web 7*b*, in a concaved curvature.

Figure 10:
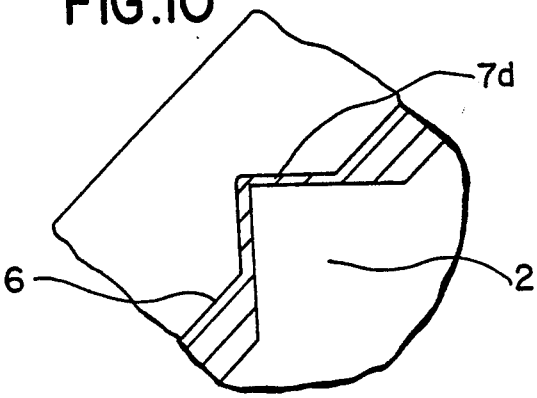

In FIG. 10, a protrusion 7*d* is formed from a thin-walled, upwardly-directed, wall portion of the base surface 6 of the receiver channel 3. The thin-wall portion 7*d* is shaped like a roof in which a peak line of the roof extends perpendicular to the receiver channel 3. One of the two side surfaces of the roof 7*d* extends in the mounting direction X of the light-transmissive shield 1.

Figure 3:
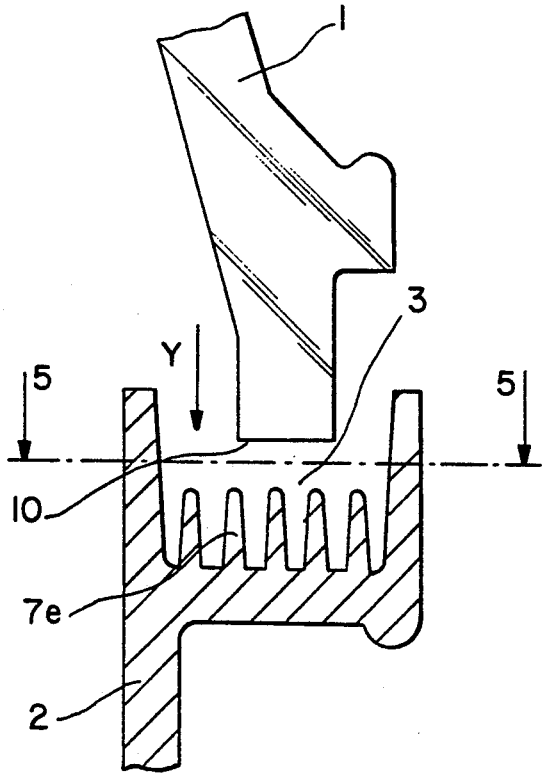
FIG. 3 is a segmented cross-sectional view similar to FIG. 1 of a headlight of a second embodiment of this invention, however, the protrusions are formed of shafts, or pins, which extend out of a base, or ground, surface of a groove.
Figure 4:
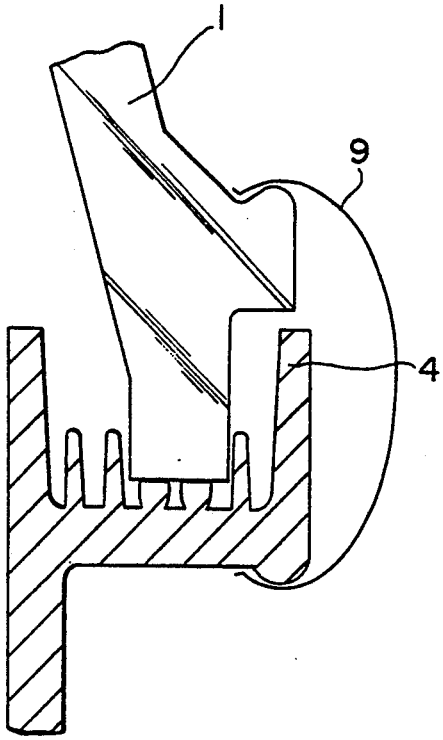
FIG. 4 is a view similar to that of FIG. 2, but of the FIG. 3 embodiment, showing a foot of a light-transmissive shield mounted in a receiver channel and held therein by a mechanical device.
Figure 5:
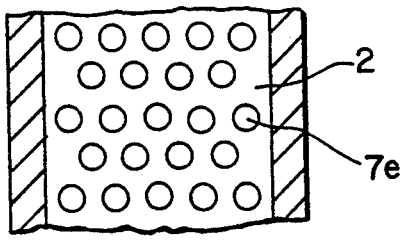
FIG. 5 is a segmented view taken in the direction Y of the receiver channel of FIG. 3 on line 5—5.

In FIGS. 3, 4 and 5 the protrusions 7*e* are thin shafts which rise up together, in the manner of a brush, from the base surface 6 of the receiver channel 3. Upon mounting the light-transmissive shield 1 in the housing 2, the thin wall shafts below the foot surface 10 of the light-transmissive shield 1 are plastically deformed and the free, or outer, ends of the other shafts are pushed to the side by means of elastic and plastic deformation. When this in done, they can support themselves on inner sides of the legs 4 of the receiver channel 3. The base surface 6 of the receiver channel 3 is constructed to be brush-like in disbursed portions over its entire length.

In order to maintain a sealed interface between the light-transmissive shield 1 and the housing it is quite beneficial if a sealing medium (not shown) is placed in the U-shaped receiver channel before the light-transmissive shield is mounted therein. A pasty, or dough-like sealing material is known which, in a warmed condition, has good fluidity and in this condition is placed in the receiving channel 3 so that after the light-transmissive shield 1 is mounted in the housing it sealingly surrounds the foot of the light-transmissive shield to form a seal therewith substantially to the edge of the receiving channel 3. After the sealing material cools it is sealingly fluid so that it serves mainly to seal. When this is done it is beneficial if between the surface 10 of the light-transmissive shield and the base surface 6 of the receiver channel 3 such a small space is created that the sealing material is held on its side surfaces by means of adhesion.

With the beneficial solution provided by this invention a light-transmissive shield is mounted by an automated device to be precisely arranged relative to its housing in that after a foot of a light-transmissive shield is placed on protrusions on the receiving surface, a pressure is exerted by the foot of the light-transmissive shield on the protrusions so that the webs or staffs are deformed and the protrusions thereby define a narrow surrounding bed, at least on one side of the foot of the light-transmissive shield. A mechanical device which holds the light-transmissive shield in the housing thereby exclusively serves to hold the foot of the light-transmissive shield in the bed and must not prevent the light-transmissive shield from wandering sidewardly, that is downwardly. Further, it is not necessary in an automated manufacturing process for the device which places the light-transmissive shield to hold it there after its placement until a mechanical device is applied.

This attaching technique for exactly arranging the light-transmissive shield on the housing is necessary so that, for a headlight that is built into a vehicle body opening, an outer surface of the light-transmissive shield provides a smooth transition with an outer surface of the vehicle body adjacent the light-transmissive shield. Further, with the inventive principles employed in this invention, it is assured that a small space which is produced between the light-transmissive shield and the adjacent vehicle body can not be made smaller by a wandering of the light-transmissive shield. If the light-transmissive shield could wander, it could otherwise come into contact with an adjacent vehicle body surface, below the light-transmissive shield, and be thereby damaged. Still further, a wandering could cause a light-transmissive shield provided with optical characteristics to no longer be correctly arranged relative to a reflector of the headlight.

Another benefit of this invention is provided if a housing therefor is constructed of a thermoplastic which is dimensionally stable at high temperatures. When the thermoplastic polypropylene is used it is beneficial that the raised areas, or protrusions, can be formed with a cold molding, or forming, process. Further, polypropylene is quite economical and because of its high-temperature dimension stability it is well suited for a headlight housing; however, when polypropylene is used, the manufacturing tolerances of the housing are quite large. Because of this last disadvantage from the use of polypropylene, it is best suited for a housing with the features of this invention. In this connection, it is further beneficial for the raised areas, or protrusions, to be formed directly on the receiving surface of the receiving channel. Such a solution is uncomplicated and can be manufactured in a cost effective manner. The deformation of the raised areas takes place in a plastic, or malleable, manner and because the housing is of a thermoplastic, this deformation is possible by application of a relatively small force. If the thermoplastic PBTP is used a warm forming or molding of the raised areas is beneficial. The raised areas can be warmed by a heating device. The higher the temperature of the raised areas, the easier it is to plastically deformed them.

It is further beneficial for the raised areas, or protrusions, to be formed as webs which are perpendicular to a length direction of the receiving surface and which extend substantially across the entire width of the receiving surface. In this regard, it is useful for the receiving surface to be formed as a base surface, or apex surface, of a U-shaped receiving frame and that the webs join together legs of the U-shaped receiving frame. By doing this, the legs of the receiving frame, upon deformation of the webs, serve as supporting elements for the webs. With these supporting elements, it is assured that an entire web is not deformed and that through deformation a bed is produced for the light-transmissive shield which has a desired depth.

A further benefit is provided if the webs are formed as thin walls. With such a solution, only a small force is necessary to deform the walls because effective concentrated pressures applied to the walls, because of their thinness, are quite great. If the thin walls are formed only on the base surface of the receiving channel, it is very beneficial for the thin walls to be directed in the mounting direction of the light-transmissive shield because this assures that the walls are plastically deformed and not bent during the mounting. When the thin walls join the legs of the receiving channel it is beneficial for them to form an acute angle to the ground surface of the receiving frame. In this manner, only a small force is required to produce deformation.

It is further beneficial for the webs to taper to a point at their free ends. Such a web is quite stable when joined with the receiving channel and its free, or outer end portion can be deformed by a small force.

Similarly, it is beneficial for the raised areas, in their cross sectional shapes, to form acute angles to one another with their side surfaces, with one of the side surfaces extending in the mounting direction of the light-transmissive shield. In this manner, the web cannot buckle away or bend over.

Further, it is beneficial if side surfaces of the webs, in cross section, define concave curves, or bows, with their side surfaces. In this manner, the outer, or free end portions of the webs are formed to be quite thin so that upon deformation thereof a high effective concentrated pressure is applied. Because, upon mounting the light-transmissive shield, the size of the cross section areas of the webs increases, variations in pressure of the light-transmissive shield on the webs changes the final position of the light-transmissive shield relative to the housing very little.

Further, it is beneficial for a foot surface of the light-transmissive shield, after deformation of the raised areas, to engage stops which are formed by projections from the receiving channel. In this manner, the exact position of the light-transmissive shield relative to the ground surface of the receiving channel of the housing can be determined for application of a particular force with which the light-transmissive shield is placed in the housing.

In another, beneficial embodiment of the invention, the raised areas are formed as small staffs, or bristles, which are arranged close to one another. When this is the case, upon mounting the light-transmissive shield in the housing, the staffs below the foot of the light-transmissive shield are pushed away by plastic and/or elastic deformation and can, when they protrude in a preferred brush-like manner from the ground surface of the receiver frame, be supported on inner surfaces of the legs of the U-shaped receiving frame.

In a particularly beneficial further embodiment of the invention, each raised area is formed from a thin-wall portion of the ground surface of the receiving frame which extends upwardly in a roof-like manner, whereby the peak of the roof extends square to the receiving frame. Such a roof deforms quite well. In such an embodiment, it is particularly beneficial for the surfaces of the roof to form a 90 degree or greater angle to one another. The top end portion of the roof can be more easily deformed the thinner the wall of the roof is. This thin-wall arrangement does not detract from the good molding-form-release properties of the roof. The roof-shaped protrusions are particularly suitable if an angle between a form, or mold, release direction of the receiving channel of the housing and the mounting direction of the light-transmissive shield is a large acute angle.

In a further beneficial embodiment of the invention, a dough-like sealing material is placed in the receiving channel which fills spaces between the U-shaped receiving bed and the foot of the light-transmissive shield. The dough-like sealing material, which mainly serves as a seal, is, before the light-transmissive shield is positioned, brought into a warmed condition and placed in the receiving frame when it displays a good fluidity and than, only thereafter, is the light-transmissive shield placed in the housing. Because of the warmed sealing material the protrusions are also warmed and can be deformed with a smaller force. Further, by means of this dough-like sealing material, the seal between the light-transmissive shield and the housing is quite good if the space for receiving the sealing material between the bed of the protrusions for affixing the foot of the light-transmissive shield and the legs of the receiving channel is correspondingly wide. Use of the dough-like sealing material is particularly beneficial if the housing is constructed of a resinous plastic material such as for example thermoplastic (polypropylene) which cannot be adhered by an economical adhesive. In this connection, it is further beneficial for the light-transmissive shield which is mounted on the housing to be held tightly thereto by mechanical devices forming clamps which have one leg engaging a shoulder of the light-transmissive shield and another leg engaging a shoulder of the housing to press the light-transmissive shield against the housing with a force. If this is done, only a few clamps are necessary because movement of the light-transmissive shield must only be prevented in a mounting direction and the clamp force is particularly suited for preventing such movement.

While the invention has been particularly shown and described with reference to a preferred embodiment, it will be understood by those of ordinary skill in the art that various changes in form and detail may be made therein without departing from the spirit and scope of the invention.

The embodiments of the invention in which an exclusive property or privilege are claimed are defined as follows:

1. A headlight for vehicles having a bowl shaped light-transmissive shield which closes a resinous plastic housing whose free peripheral edge has a receiving surface approximately perpendicular to a mounting direction of a foot of the light-transmissive shield, said foot of the light-transmissive shield being mounted on the receiving surface with a large clearance perpendicular to the mounting direction, a pressing mechanical device for affixing the light-transmissive shield to the housing by pressing the foot of the light-transmissive shield towards the receiving surface;

wherein a seating of the light-transmissive shield comprises protrusions rising from the receiving surface which, upon the light-transmissive shield being mounted on the housing, are deformed by a pressure of the foot of the light-transmissive shield on the protrusions so that some of the protrusions extend at least along one side of the foot of the light-transmissive shield to form a narrow surrounding bed for the foot of the light-transmissive shield.

2. A headlight as in claim 1 wherein the housing is manufactured of a high-temperature, dimension-stable, thermoplastic.

3. A headlight as in claim 2 wherein the thermoplastic is polypropylene.

4. A headlight as in claim 2 wherein the thermoplastic is polybutylenterephthalat (PBTP).

5. A headlight as in claim 1 wherein said housing includes a limiting leg continuously formed on the receiving surface, which together with the receiving surface forms an L-shape in cross section.

6. A headlight as in claim wherein said housing includes two limiting legs continuously formed on the receiving surface to define a U-shaped channel in cross section with the receiving surface.

7. A headlight as in claim 6 wherein the protrusions are formed directly on a ground surface of the U-shaped receiving channel, which serves as the receiving surface.

8. A headlight as in claim 1 wherein the protrusions are webs which extend square to a direction of elongation of the receiving surface and extend substantially over the entire width of the receiving surface.

9. A headlight as in claim 6 wherein the protrusions are webs and wherein the webs join the legs of the U-shaped receiving channel.

10. A headlight as in claim 8 wherein the webs are thin walls.

11. A headlight as in claim 8 wherein the webs taper to pointed outer end edges thereof.

12. A headlight as in claim 11 wherein the protrusions have side surfaces which form acute angles to one another in cross section.

13. A headlight as in claim 11 wherein one of the side surfaces of each web extends in the mounting direction of the light-transmissive shield in the housing.

14. A headlight as in claim 11 wherein the side surfaces of the webs defined concaved arches in cross sections of the webs.

15. A headlight as in claim 1 wherein outwardly projecting stops are formed on the receiving surface for contacting a foot surface of the light-transmissive shield after the protrusions have been deformed.

16. A headlight as in claim 1 wherein the protrusions are staffs which are densely arranged near one another.

17. A headlight as in claim 16 wherein the staffs extend together outwardly from the receiving surface in a brush-like manner.

18. A headlight as in claim 1 wherein the protrusions are formed from a thin wall portion of the receiver surface directed upwardly in the shape of a roof, with a peak line of the roof being squared to a length direction of the receiving surface.

19. A headlight as in claim 18 wherein side surfaces of the roof extend at an angle to one another which is at least as large as a square angle.

20. A headlight as in claim 1 wherein a dough-like material is placed on the receiving surface to fill a space between the receiving surface and a foot of the light-transmissive shield.

21. A headlight as in claim 6 wherein a dough-like material is placed in the receiving channel to fill a space between the U-shaped channel and a foot of the light-transmissive shield.

22. A headlight as in claim 1 wherein a mechanical device serving as a clamp is placed on the outer surface of the headlight with one leg engaged on a shoulder of an exterior portion of the light-transmissive shield and another leg engaged on a shoulder of the housing.

23. A headlight as in claim 10 wherein the thin wall extends at an acute angle to the ground surface of the receiving channel.

24. A method of constructing a headlight for vehicles having a bowl shaped light-transmissive shield which closes a resinous plastic housing whose free peripheral edge has a receiving surface approximately perpendicular to a mounting direction of a foot of the light-transmissive shield, said foot of the light-transmissive shield being mounted on the receiving surface with a large clearance perpendicular to the mounting direction, comprising the steps of:

creating a seating for the light-transmissive shield on the receiving surface comprised of protrusions rising from the receiving surface which, upon the light-transmissive shield being mounted on the housing, are deformed by a pressure of the foot of the light-transmissive shield on the protrusions; and applying a mechanical device to the light-transmissive shield and the housing for affixing the light-transmissive shield to the housing by pressing the foot of the light-transmissive shield towards the receiving surface so that some of the protrusions are deformed to extend at least along one side of the foot of the light-transmissive shield to form a narrow surrounding bed for the foot of the light-transmissive shield.

* * * * *